US007391876B2

(12) United States Patent
Cohen et al.

(10) Patent No.: US 7,391,876 B2
(45) Date of Patent: Jun. 24, 2008

(54) METHOD AND SYSTEM FOR SIMULATING A 3D SOUND ENVIRONMENT

(75) Inventors: Yuval Cohen, Migdal Haemek (IL); Amir Bar On, Rehovot (IL); Giora Naveh, Rehovot (IL); Haim Levy, Ra'anana (IL)

(73) Assignee: BE4 Ltd., Rehovot (IL)

( * ) Notice: Subject to any disclaimer, the term of this patent is extended or adjusted under 35 U.S.C. 154(b) by 441 days.

(21) Appl. No.: 10/471,140

(22) PCT Filed: Mar. 3, 2002

(86) PCT No.: PCT/IL02/00158

§ 371 (c)(1),
(2), (4) Date: Mar. 5, 2004

(87) PCT Pub. No.: WO02/071797

PCT Pub. Date: Sep. 12, 2002

(65) Prior Publication Data

US 2004/0136538 A1 Jul. 15, 2004

(30) Foreign Application Priority Data

Mar. 5, 2001 (IL) ..... 141822

(51) Int. Cl.
*H04R 5/00* (2006.01)
*H04R 5/02* (2006.01)

(52) U.S. Cl. ..... 381/309; 381/17

(58) Field of Classification Search ..... 381/26, 381/74

See application file for complete search history.

(56) References Cited

U.S. PATENT DOCUMENTS

| | | | | |
|---|---|---|---|---|
| 3,920,904 | A | 11/1975 | Blauert et al. | 179/1 G |
| 4,143,244 | A * | 3/1979 | Iwahara et al. | 381/310 |
| 5,173,944 | A * | 12/1992 | Begault | 381/17 |
| 5,333,200 | A * | 7/1994 | Cooper et al. | 381/1 |
| 6,072,877 | A * | 6/2000 | Abel | 381/17 |
| 6,574,339 | B1 * | 6/2003 | Kim et al. | 381/17 |

* cited by examiner

*Primary Examiner*—Xu Mei
(74) *Attorney, Agent, or Firm*—Ladas & Parry, LLP

(57) ABSTRACT

The invention provides a method for simulating a 3D sound environment in an audio system using an at least two-channel reproduction device, the method including generating first and second pseudo head-related transfer function (HRTF) data, first using at least one speaker and then using headphones; dividing the first and second frequency representation of the data or using a deconvolution operator on the time domain representation of the first and second data, or subtracting the cepstrum representation of the first and second data, and using the results of the division or subtraction to prepare filters having an impulse response operable to initiate natural sounds of a remote speaker for preparing at least two filters connectable to the system in the audio path from an audio source to sound reproduction devices to be used by a listener.

6 Claims, 8 Drawing Sheets

METHOD AND SYSTEM FOR SIMULATING A 3D SOUND ENVIRONMENT

FIELD OF THE INVENTION

The present invention relates generally to a method of analyzing and simulating a 3D sound environment in an audio system, using an at least two-channel reproduction device.

BACKGROUND OF THE INVENTION

It is a fact that surround and multi-channel sound tracks are gradually replacing stereo as the preferred standard of sound recording. Many new audio devices are equipped with surround capabilities, and most new sound systems sold today are multi-channel systems equipped with multiple speakers and surround sound decoders. In fact, many companies have devised algorithms that modify old stereo recordings so that they will sound as if they were recorded in surround. Other companies have developed algorithms that upgrade older stereo systems to produce surround-like sound using only two speakers. Stereo-expansion algorithms enlarge perceived ambiance, and many sound boards and speaker systems contain the circuitry necessary for delivering expanded stereo sound.

3-D positioning algorithms take matters a step further by seeking to place sounds in particular locations around the listener—to his left or right, above him or below, all in respect to the image displayed. These algorithms are based upon simulating psycho-acoustic cues, replicating the way sounds are actually heard in a 360-degree space. These algorithms often use a head-related transfer function (HRTF) to calculate a sound heard at the listener's ears relative to the spatial coordinates of the sound's origin. For example, a sound emitted by a source located to one's left is first receipted by the left ear and only a split second later by the right one. The relative amplitude of different frequencies also varies, due to the directionality of the pinna and the obstruction of the listener's own head.

As stated above, an HRTF is the measured transformation of sound from a point in space to a specific eardrum. Reproducing the same acoustic information at the ear drums as found in natural free-field listening can create a virtual sound source.

Therefore it is clear that attempts are being made to improve the methods for acquiring HRTF data in order to improve, in turn, the capability to simulate virtual sound sources, using a headphone or speakers. Two of these prior art methods are:

1) using a dummy head with a microphone placed in the location of the ear drums, the dummy head simulating the human head and ears, and
2) placing small microphones inside a subject's ear canal. Due to physical limitations, microphones are placed only halfway into the ear canal.

The measured microphone output represents the individual or dummy head's specific HRTF information. In order to simulate a virtual sound source, the sound signal is convolved with the measured HRTF information.

The above-mentioned prior art methods suffer from the following drawbacks:

1) Since each person has unique HRTF data which represents his unique ears and head sound transformation, the result of using non-individualized HRTF data which was measured using a dummy head or a specific subject, causes a non-satisfactory 3D sensation. This problem affects mostly the higher frequencies, thus causing front-back confusion and an "inside the head" sensation.
2) Another drawback is that the measurements were done near the eardrum, yet the reproduction is done outside the ear, causing the sound to be convolved twice, once using the reference HRTF of the dummy head or specific subject and once using the individual HRTF of the person listening to the headphones. This, of course, causes an inaccurate reproduction of the sound, resulting in an unsatisfactory 3D audio sensation.
3) In order to conduct such an experiment, additional stimulation and measurement equipment must be used. Such equipment (speakers, amplifiers, microphones, etc.) would inevitably influence the measurement by distorting the stimuli and the measured signals. Some components have a linear transfer function, such as the room, the air, the head, the pinnas and ear canals; some have a non-linear transfer function, such as amplifiers, speakers and microphones. A skillful conductor of such an experiment would be able to eliminate the linear influence of the measurement equipment by pre-measuring its frequency response and taking that into account during the analysis. However, current signal-processing techniques are usually unable to eliminate the non-linear portions of equipment distortion.
4) In prior art two-speaker surround systems, the listener must be located exactly between the speakers. Any deviation from that spot results in a distorted sound image.
5) Prior art two-speaker surround systems perform well only in symmetrical environments. The speakers must be matched and the room's acoustics must be symmetrical. This restriction prevents many users from enjoying surround sound over two speakers.
6) Prior art 3D headphone systems provide non-satisfactory 3D sound, mainly causing front-back confusion and an "inside the head" sensation.

SUMMARY OF THE INVENTION

It is therefore a broad objective of the present invention; to provide a measurement and reproduction method and a system which overcomes the disadvantages of the prior art technology, in that it adapts itself to the listener's HRTF data, thus achieving the most accurate 3D sound reproduction; is adapted for reproduction of sound outside the ear canal; cancels out distortion and the influence of both the linear and non-linear portions of the measurement equipment; creates a virtual surround sound environment, while using less speakers (two or more) and without requiring the user to sit in the center or to change his room's acoustic behavior, and provides significantly better 3D simulation using headphones, in which simulated sound sources are perceived "out of the head" and without any tonal change whatsoever.

In accordance with the present invention, the above objective is achieved by providing a method for simulating a 3D sound environment in an audio system using an at least two-channel reproduction device, said method comprising generating first and second pseudo head-related transfer function (HRTF) data, first using at least one speaker and then using headphones; dividing said first and second frequency representation of said data or using a deconvolution operator on the time domain representation of said first and second data, or subtracting the cepstrum representation of said first and second data, and using the results of said division or subtraction to prepare filters having an impulse response operable to initiate natural sounds of a remote speaker for preparing at least two filters connectable to said system in the audio path from an audio source to sound reproduction devices to be used by a listener.

The invention also provides a method for simulating a 3D sound environment using at least one speaker, said method comprising placing a dummy head having dummy left and right ears, pinnas and ear canals, in a selected acoustic environment; recording first and second head-related transfer functions (HRTF) sound data transmitted via said speaker and received at said dummy head by first and second microphones; recording third and fourth HRTF sound data transmitted to said dummy head via a pair of headphones; preparing transfer functions for left and right ear filters for each audio source channel by dividing, deconvolving or subtracting, respectively, said first and second frequency representation of said sound data and said third and fourth sound data of each speaker, and introducing said left and right filters in a sound reproduction system between each audio source channel and two sound transducers connected to said system.

The invention further provides a method for simulating a 3D sound environment using at least one speaker, said method comprising locating a listener's head, fitted with a miniature microphone in each ear canal, in a selected acoustic environment; recording first and second head-related transfer functions (HRTF) sound data transmitted via said speaker and received by said microphones; recording third and fourth HRTF sound data transmitted to said listener's head via said microphones; preparing transfer functions for left and right ear filters for each audio source channel by dividing, deconvolving or subtracting, respectively, said first and second frequency representation of said sound data and said third and fourth sound data of each speaker, and introducing said left and right filters in a sound reproduction system between each audio source channel and two sound transducers connected to said system.

The invention still further provides an audio system for simulating a 3D sound environment having an audio source, audio reproducing and processing means and at least two speakers or headphones, said system comprising at least two filters, each filter being connected between said audio source and one of said speakers or headphones; each of said filters being characterized by an impulse response obtained by generating pseudo head-related transfer functions prepared by the method described herein.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

Figure 1B:
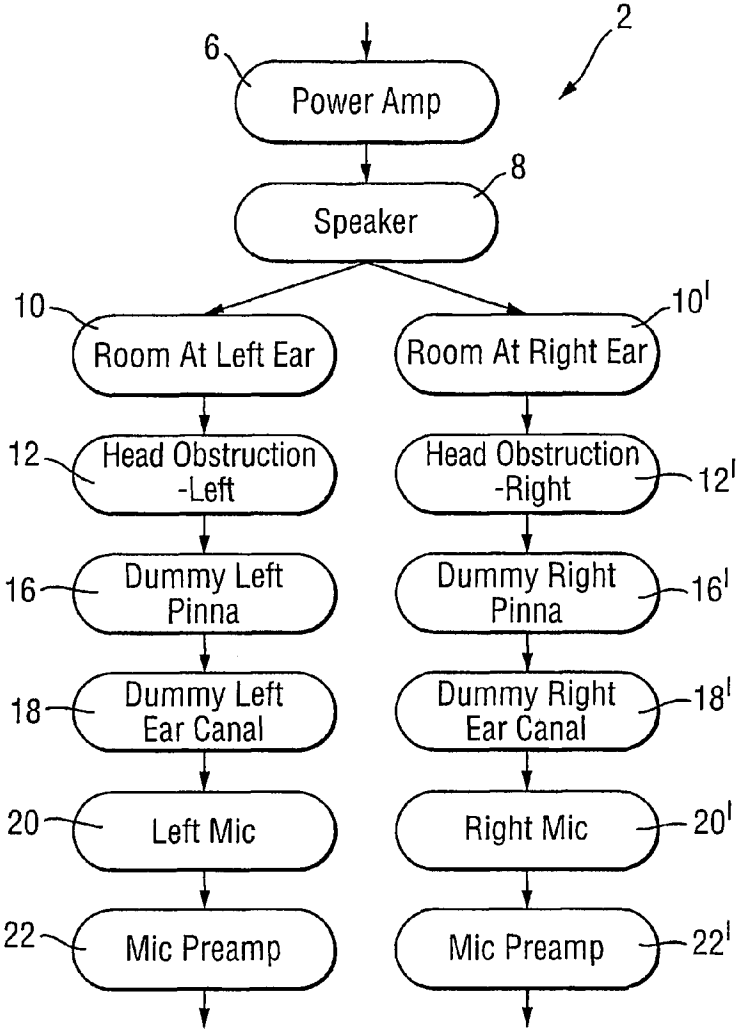
Figure 1A:
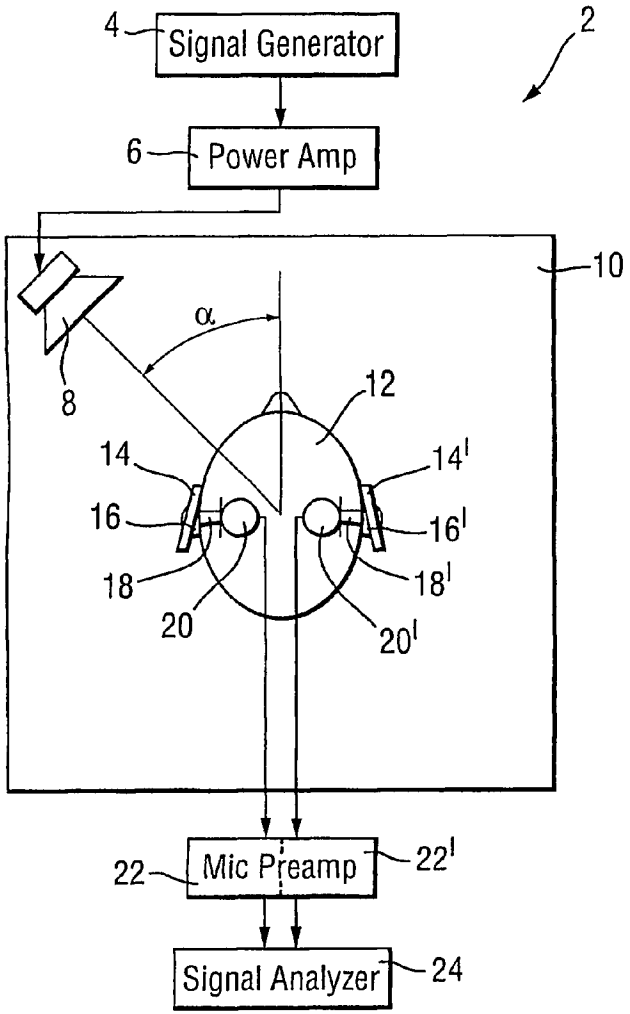
Figure 2A:
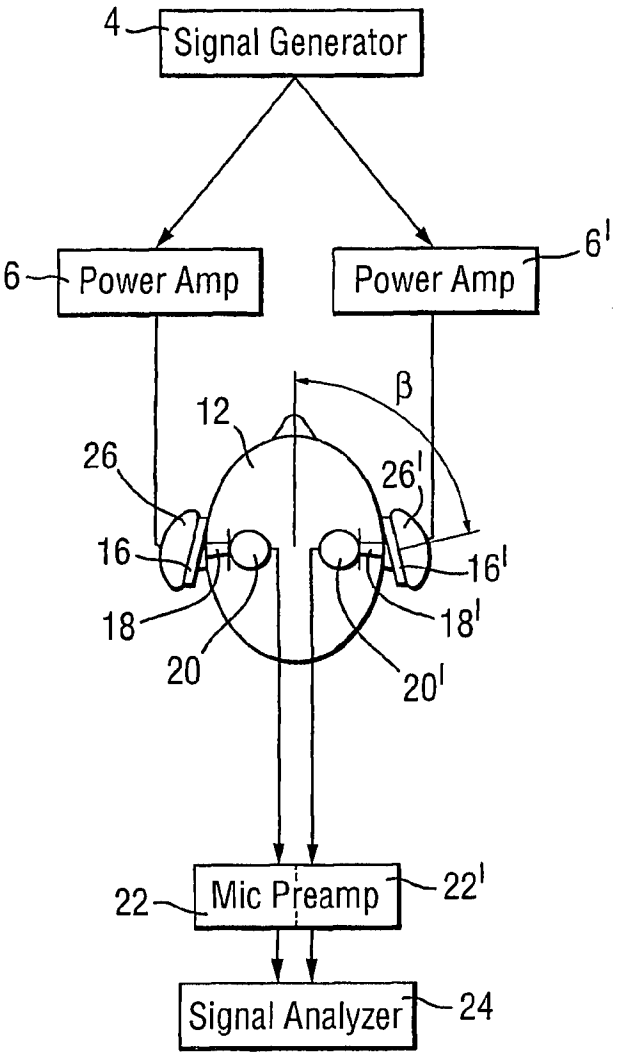
Figure 2B:
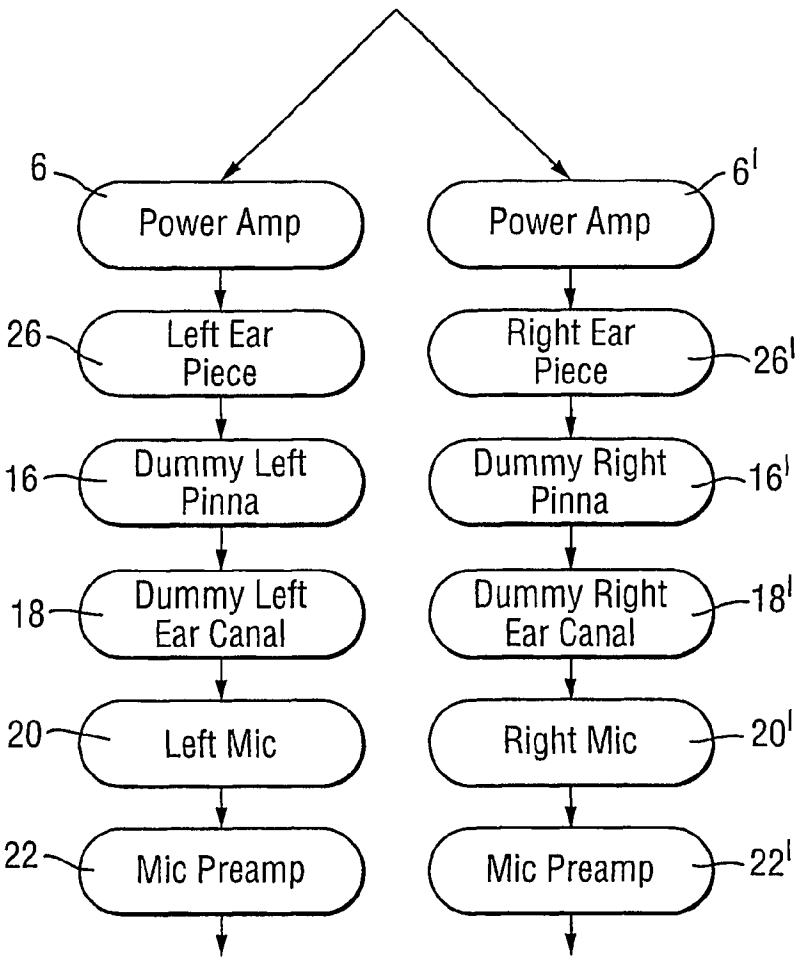
Figure 3B:
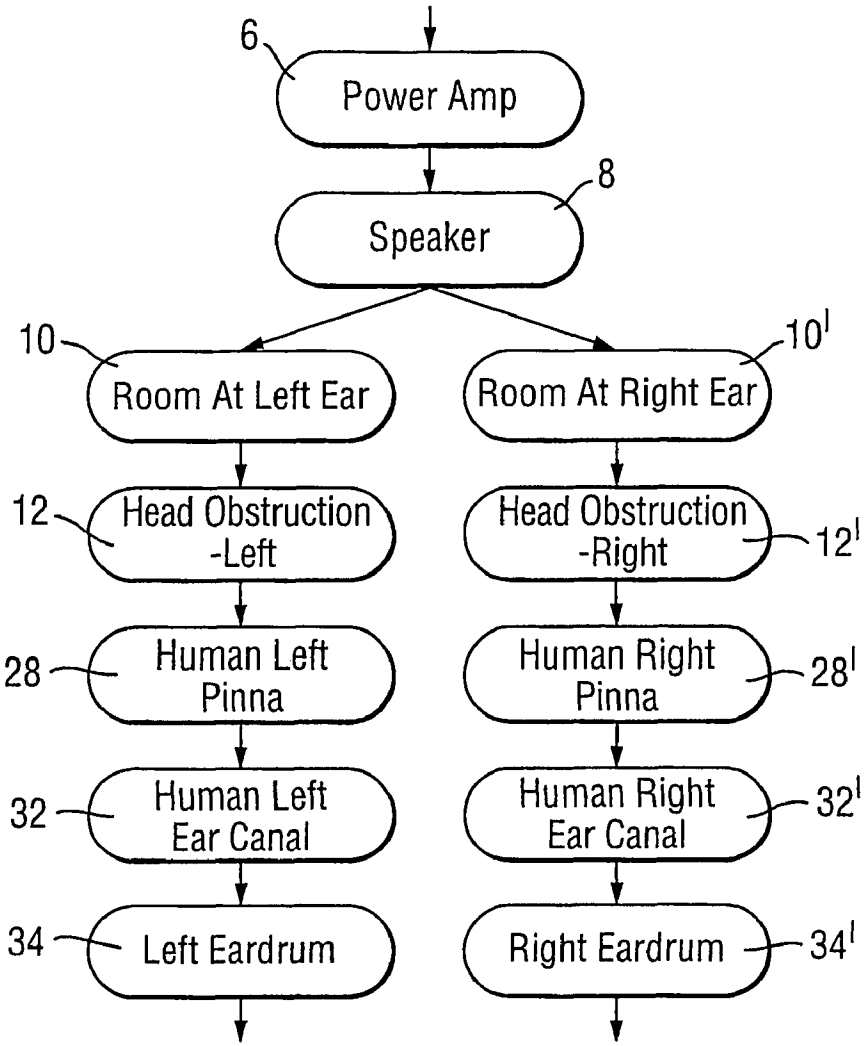
Figure 3A:
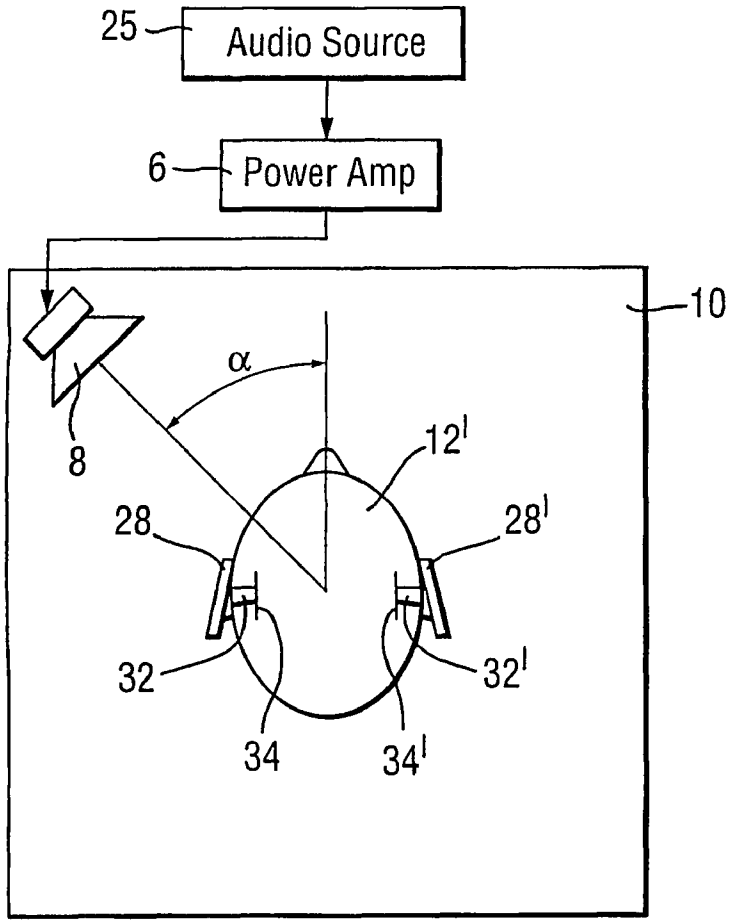
Figure 4B:
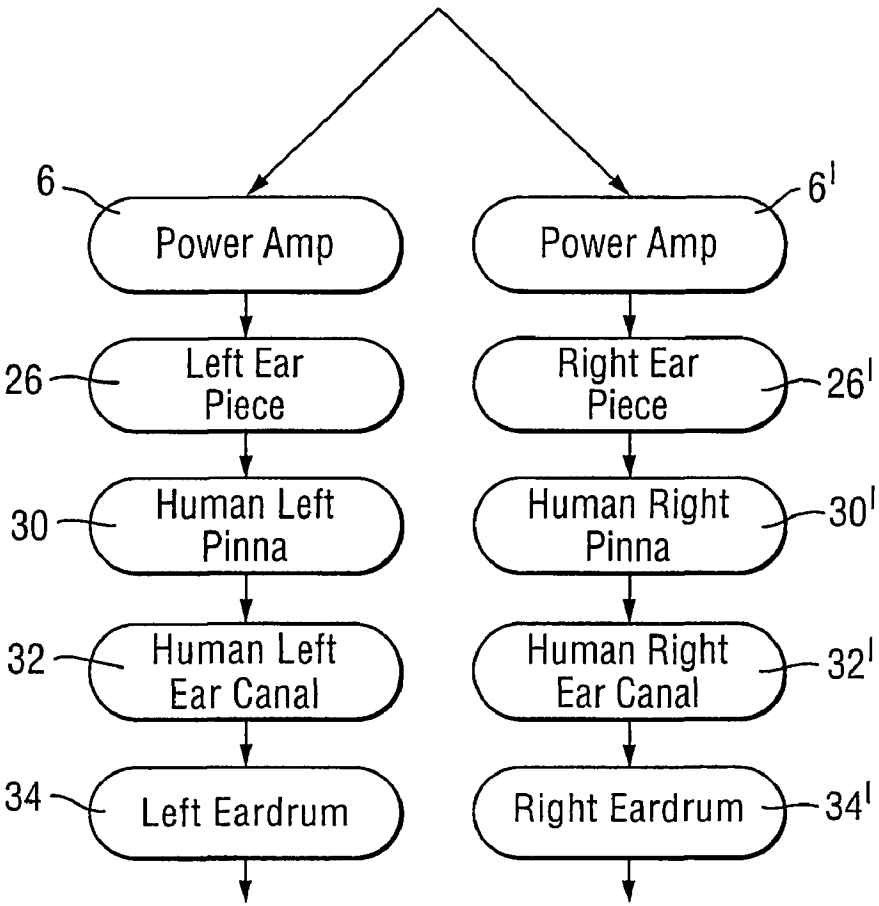
Figure 4A:
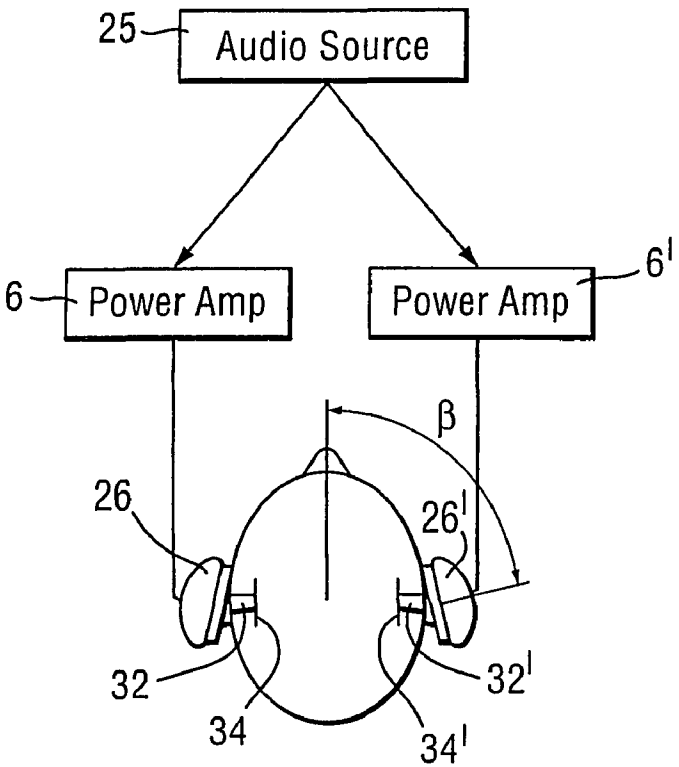
Figure 5B:
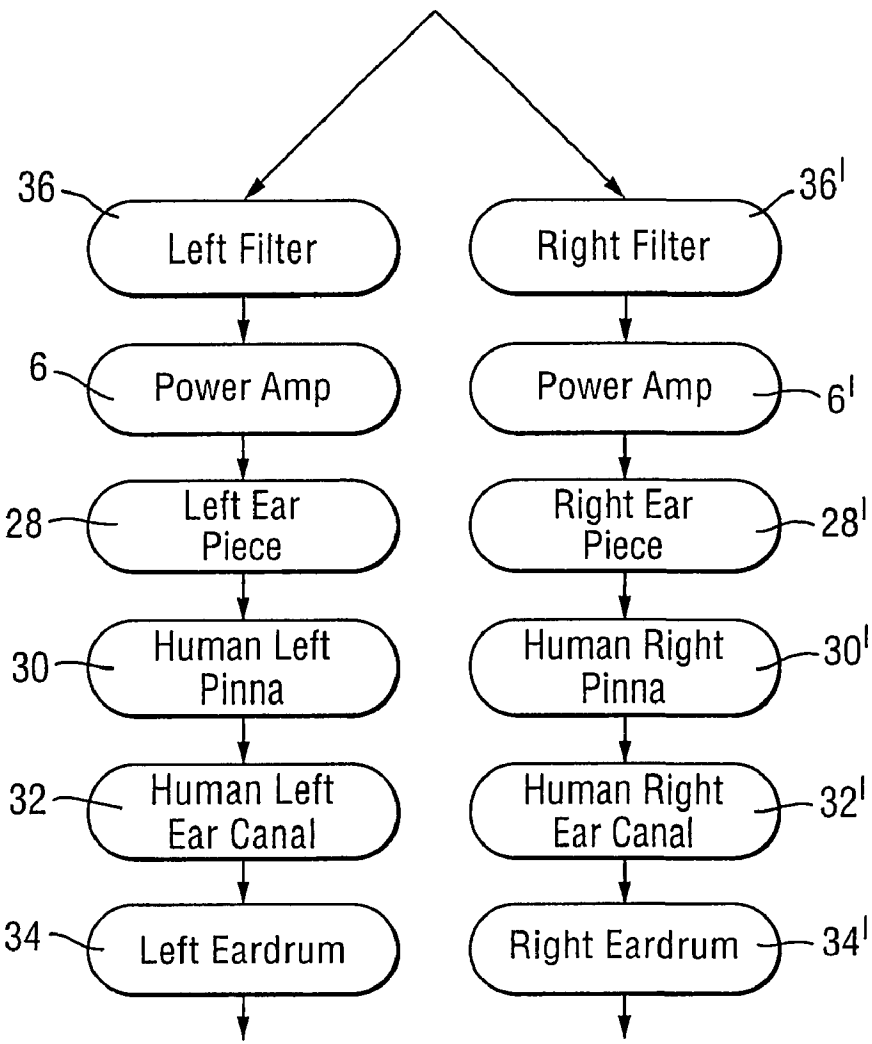
Figure 5A:
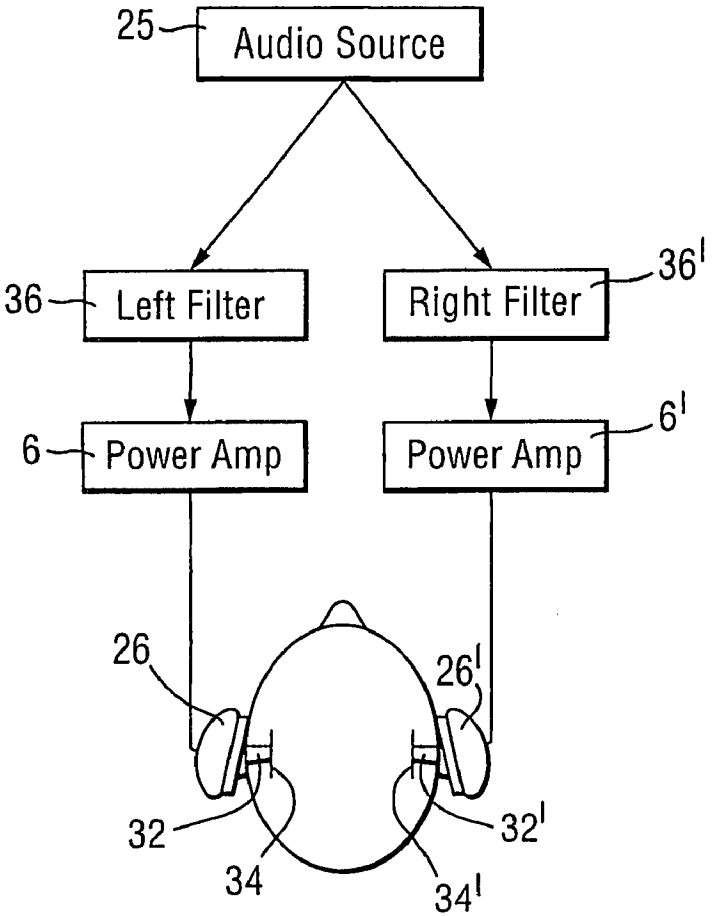
Figure 6:
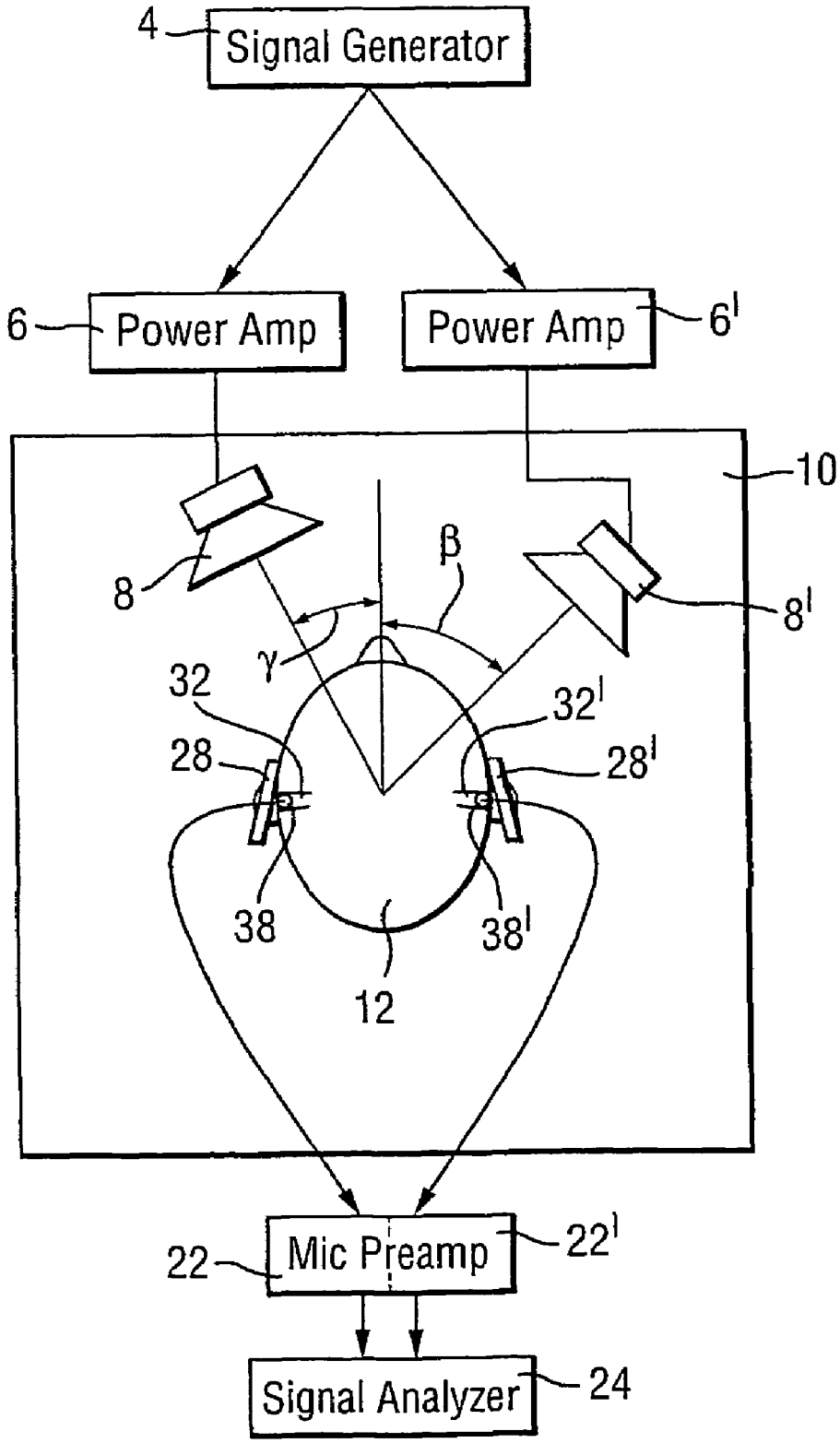
Figure 7:
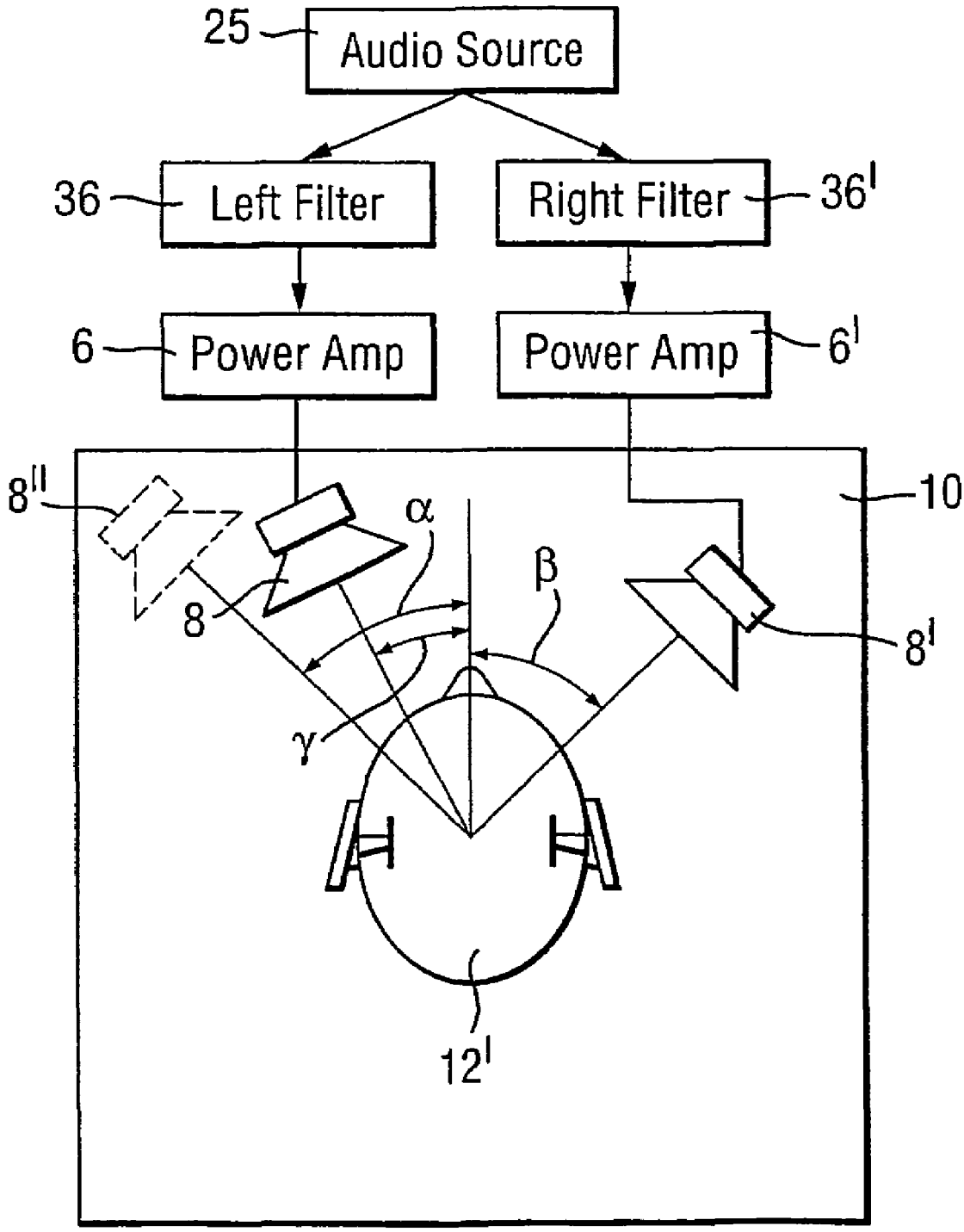
Figure 8:
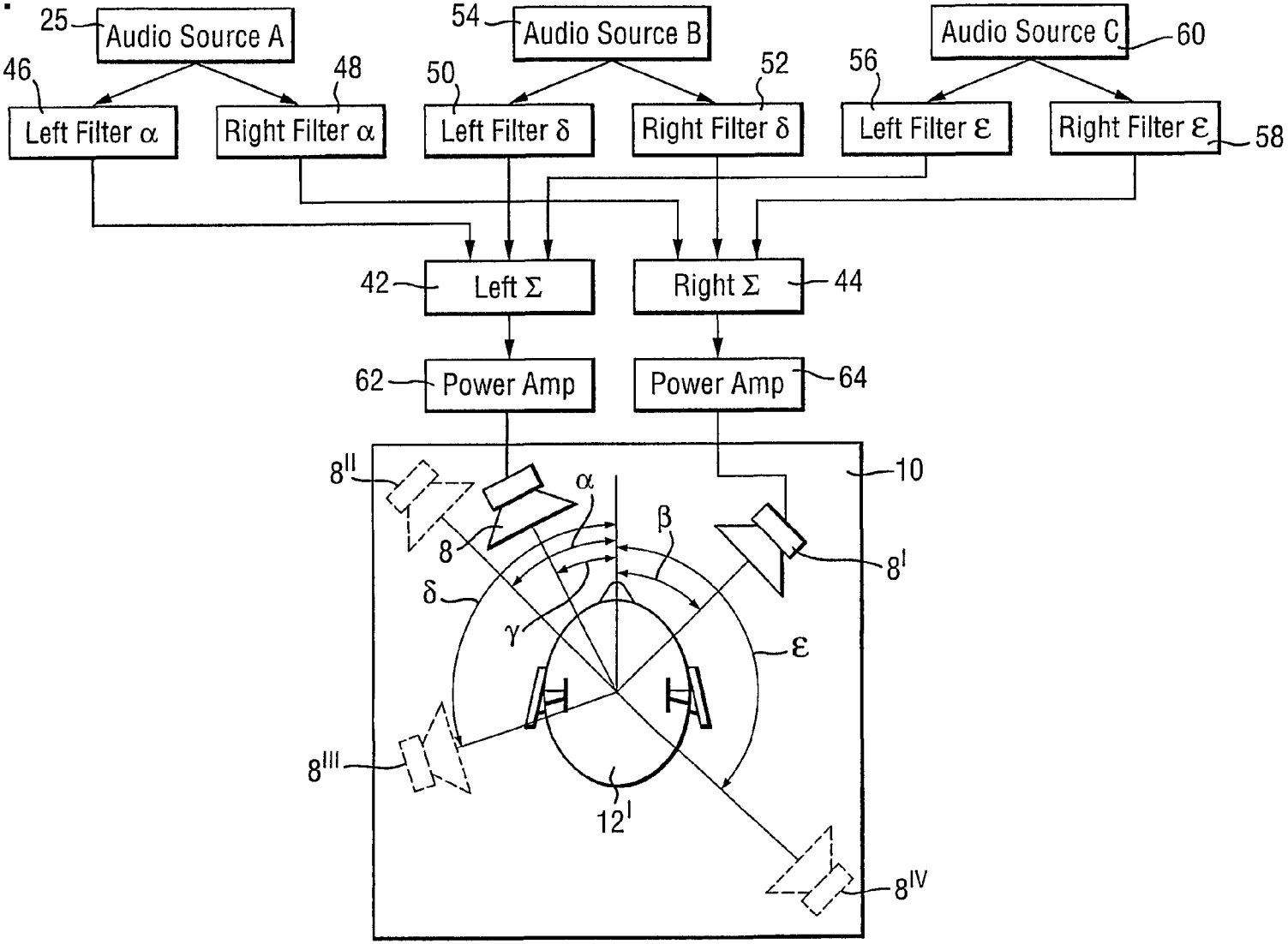

FIGS. 1A and lB illustrate a system for recording an audio signal originating in an open field transducer inside a human ear canal, using a dummy head;

FIGS. 2A and 2B illustrate a system for headphone measurement, using the same equipment used for the open air experiment illustrated in FIG. 1;

FIGS. 3A and 3B are schematic illustrations of a subject listening to an audio track, using one speaker;

FIGS. 4A and 4B are schematic illustrations of a subject listening to an audio track, using headphones;

FIGS. 5A and 5B are schematic illustrations of a 3D sound environment virtualizing system for headphones;

FIG. 6 is a schematic illustration of an on-site measurement system for a speaker-based 3D sound environment virtualizing system;

FIG. 7 illustrates a speaker-based 3D sound environment virtualizing system, and FIG. 8 illustrates a two-speaker virtualizing system, simulating three virtual speakers.

DETAILED DESCRIPTION

FIGS. 1A and lB depict a system 2 for recording an audio signal originating in an open field, using a dummy head and a transducer located in place of each ear drum. The signal is recorded in order to obtain the HRTF parameters for one specific angle $\alpha$, representing, in this case, a front left speaker. The signal generator 4 generates the test signal used for the measurement. The signal is amplified by a power amplifier 6 and reproduced by a speaker 8. The acoustic characteristics of the room 10 affect the sound, adding early reflections and reverberations to the direct sound. The influence of the room is different in each location, hence, the sound arriving at the left ear of head 12 is different from the sound arriving at the right one. The head 12 affects the sound, reflecting it into one ear 14 and obstructing it from the other ear 14'. The sound passes through the pinnas 16, 16' and ear canals 18, 18' of head 12 before it is recorded by microphones 20, 20'. The output signals of microphones 20, 20' are amplified by microphone pre-amplifiers 22, 22' and analyzed by signal analyzer 24. Signal analyzer 24 analyzes two separate signals: one of the left ear 14, and one of the right ear 14'.

By comparing the original signals and the measured signal, the conductor of the test can obtain the transfer function of the entire system.

In practice, the obtained transfer function is comprised of a series of transfer functions of each and every component in the signal path. The measured transfer functions $DS^{\alpha}_{(Left)}$ and $DS^{\alpha}_{(Right)}$ can be represented as a multiplication of several transfer functions (refer to blocks 6 through 22 in FIG. 1B):

$$DS^{\alpha}_{(left)} = \begin{bmatrix} H_{(\text{Power_amplifier})} \otimes H_{(Speaker)} \otimes H^{\alpha}_{(\text{Room_at_left_ear})} \otimes \\ H^{\alpha}_{(\text{Head_obstruction_at_left_ear})} \otimes H^{\alpha}_{(\text{Dummy_head_left_pinna})} \otimes \\ H_{(\text{Dummy_head_left_ear_canal})} \otimes H_{(\text{Right_microphone})} \otimes \\ H_{(\text{Microphone_pre_amplifier})} \end{bmatrix} \quad (1)$$

$$DS^{\alpha}_{(Right)} = \begin{bmatrix} H_{(\text{Power_amplifier})} \otimes H_{(Speaker)} \otimes H^{\alpha}_{(\text{Room_at_right_ear})} \otimes \\ H^{\alpha}_{(\text{Head_obstruction_at_right_ear})} \otimes H^{\alpha}_{(\text{Dummy_head_right_pinna})} \otimes \\ H_{(\text{Dummy_head_right_ear_canal})} \otimes H_{(\text{Right_microphone})} \otimes \\ H_{(\text{Microphone_pre_amplifier})} \end{bmatrix} \quad (2)$$

wherein:

the transfer functions mentioned above depend on the speaker angle $\alpha$ and are marked $H^{\alpha}$;

DS is Dummy-Speaker constellation, and $\otimes$ is Convolution operator (in time domain environment).

Referring now to FIGS. 2A and 2B, there is illustrated a setup for headphone measurement, using the same equipment used in the open field system and method described above with regard to FIGS. 1A and 1B. This time, the audio source is headphones 26, 26', which are placed on the dummy head 12. The angle β between the head's median plane and the axis of each ear-piece of headphones 26, 26' is fixed, and depends on the mechanical structure of the headphones. The signal generator 4 generates the test signal, which is amplified by power amplifiers 6, 6' and reproduced by the headphones 26, 26'. The sound passes through the pinnas 16, 16' and ear canals 18, 18' of dummy head 12 before it is recorded by microphones 20, 20'. The output signal of the microphones 20, 20' is amplified by microphone pre-amplifiers 22, 22' and analyzed by signal analyzer 24. Signal analyzer 24 analyzes two separate signals: one from the left ear 14 and one from the right 14'.

By comparing the original signals with the measured signal, the conductor of the test can obtain the transfer function of this system.

The measured transfer functions $DP^{\beta}_{(Left)}$ and $DP^{\beta}_{(Right)}$ can be represented as a multiplication of several transfer functions (refer to blocks 6, 6' to 22, 22' in FIG. 2B):

$$DP^{\beta}_{(left)} = \begin{bmatrix} H_{(\text{power_amplifier})} \otimes H_{(\text{left_ear_piece})} \otimes H^{\beta}_{(\text{Dummy_head_left_pinna})} \otimes \\ H_{(\text{Dummy_head_left_ear_canal})} \otimes H_{(\text{Left_microphone})} \otimes \\ H_{(\text{Microphone_pre_amplifier})} \end{bmatrix} \quad (3)$$

$$DP^{\beta}_{(Right)} = \begin{bmatrix} H_{(\text{Power_amplifier})} \otimes H_{(\text{Right_ear_piece})} \otimes \\ H^{\beta}_{(\text{Dummy_head_right_pinna})} \otimes H_{(\text{Dummy_head_right_ear_canal})} \otimes \\ H_{(\text{Right_microphone})} \otimes H_{(\text{Microphone_pre_amplifier})} \end{bmatrix} \quad (4)$$

wherein:

DP is Dummy-Headphones constellation.

FIGS. 3A and 3B describe the situation of a person listening to audio source 25 via a single speaker 8. The audio source 25 generates the audio signal, which is amplified by power amplifier 6 and reproduced by speaker 8. The acoustic characteristics of the room 10 affect the sound, adding early reflections and reverberations. The influence of the room is different in each location, hence, the sound arriving at the left ear 28 is different from that arriving at the right one 28'. The person's head 12' affects the sound by reflecting it into one ear 28 and obstructing it from the other 28'. The sound passes through the pinnas 30, 30' and ear canals 32, 32', causing the left and-right eardrums 34, 34' to vibrate. The vibrations are translated into nerve impulses by the inner ears; these impulses finally arrive at the user's brain. While traveling to the brain, the original audio track is modified. The overall modification can be described as a series of blocks, each of which has a different transfer function (refer to blocks 6, 6' to 34, 34' in FIG. 3B).

Provided that the transfer function of the entire system is $HS^{\alpha}_{(Left)}$ and $HS^{\alpha}_{(Right)}$:

$$HS^{\alpha}_{(Left)} = \begin{bmatrix} H_{(\text{power_amplifier})} \otimes H_{(Speaker)} \otimes H^{\alpha}_{(\text{Room_at_left_ear})} \otimes \\ H^{\alpha}_{(\text{Human_head_obstruction_at_left_ear})} \otimes H^{\alpha}_{(\text{Human_left_pinna})} \otimes \\ H_{(\text{Human_left_ear_canal})} \otimes H_{(\text{Left_eardrum})} \end{bmatrix} \quad (5)$$

-continued $$HS^{\alpha}_{(Right)} = \begin{bmatrix} H_{(\text{Power_amplifier})} \otimes H_{(Speaker)} \otimes H^{\alpha}_{(\text{Room_at_right_ear})} \otimes \\ H^{\alpha}_{(\text{Human_head_obstruction_at_right_ear})} \otimes H^{\alpha}_{(\text{Human_right_pinna})} \otimes \\ H_{(\text{Human_right_ear_canal})} \otimes H_{(\text{Right_eardrum})} \end{bmatrix} \quad (6)$$

wherein:

HS is Human-Speaker constellation.

FIGS. 4A and 4B, corresponding to FIGS. 2A and 2B, illustrate a person listening to audio material via headphones. The audio source 25 generates the audio signal, which is amplified by power amplifiers 6, 6' and reproduced by headphones 26, 26'. The sound passes through the person's pinnas 30, 30' and ear canals 32, 32', causing the left and right eardrums 34, 34' to vibrate. The inner ear translates the vibrations into nerve impulses and those impulses finally arrive at the brain. The original audio track is modified during its path to the brain. The overall modification can be described as a series of blocks, each of which has a different transfer function (refer to blocks 6, 6' to 34, 34' in FIG. 4B).

Provided that the transfer function of the entire system is $HP^{\alpha}_{(Left\ ear)}$ and $HP^{\alpha}_{(Right\ ear)}$:

$$HP^{\beta}_{(Left)} = \begin{bmatrix} H_{(\text{Power_amplifier})} \otimes H_{(\text{Left_ear_piece})} \otimes H^{\beta}_{(\text{Human_left_pinna})} \otimes \\ H_{(\text{Human_left_ear_canal})} \otimes H_{(\text{Left_eardrum})} \end{bmatrix} \quad (7)$$

$$HP^{\beta}_{(Right)} = \begin{bmatrix} H_{(\text{Power_amplifier})} \otimes H_{(\text{Right_ear_pierce})} \otimes H^{\beta}_{(\text{Human_right_pinna})} \otimes \\ H_{(\text{Human_right_ear_canal})} \otimes H_{(\text{Right_eardrum})} \end{bmatrix} \quad (8)$$

wherein:

HP is Human-Headphones constellation.

A headphones virtualizing system is shown in FIGS. 5A and 5B. In this system, two filters 36, 36' are placed in the path of the audio material. The rest of the audio path is similar to that described above with regard to FIGS. 4A and 4B.

The transfer function of the left filter 36 in prior art surround headphones, is:

$$F_{(Left)}{}^{\alpha} = DS_{(Left)}{}^{\alpha} \quad (9)$$

The transfer function of the right ear filter 36' is:

$$F_{(Right)}{}^{\alpha} = DS_{(Right)}{}^{\alpha} \quad (10)$$

According to the present invention, different filters are used. The transfer function of the left ear filter 6 is:

$$F^{\alpha}_{(Left)} = \frac{DS^{\alpha}_{(Left)}}{DP^{\beta}_{(Left)}} \quad (11)$$

The transfer function of the right ear filter 6' is:

$$F^{\alpha}_{(Right)} = \frac{DS^{\alpha}_{(Right)}}{DP^{\beta}_{(Right)}} \quad (12)$$

The overall transfer function of that system would be:

$$HV^{\beta}_{(Left)} = \begin{bmatrix} F^{\alpha}_{(Left)} \otimes H_{(\text{Power_amplifier})} \otimes H_{(\text{Left_ear_piece})} \otimes \\ H^{\beta}_{(\text{Human_left_pinna})} \otimes H_{(\text{Human_left_ear_canal})} \otimes H_{(\text{Left_eardrum})} \end{bmatrix} \quad (13)$$

$$HV^{\beta}_{(Right)} = \begin{bmatrix} F^{\alpha}_{(Right)} \otimes H_{(\text{Power_amplifier})} \otimes H_{(\text{Right_ear_piece})} \otimes \\ H^{\beta}_{(\text{Human_right_pinna})} \otimes H_{(\text{Human_right_ear_canal})} \otimes \\ H_{(\text{Right_eardrum})} \end{bmatrix} \quad (14)$$

wherein:

HV is Human-Virtualized constellation.

Alternatively, instead of dividing the right and left data, the filters can be calculated by using a deconvolution operator on the time domain representation of the right and left data, or subtracting the cepstrum representation of the right and left data.

An on-site measurement system for a speaker based virtualizer system according to the present invention, is illustrated in FIG. 6. The purpose of this measurement is to obtain information about the real playback conditions in the listener's playback room. The measurement is based on miniature microphones placed close to, or inside, the listener's ear canal. The speaker quality, speaker placement and room acoustics affect the measurement. In contrast to prior art speaker virtualizing systems, speaker placement is not important; the system will perform well even in non-symmetrical environments. The signal generator 4 generates the test signal used for the measurement. The signal is amplified by power amplifier 6, 6' and reproduced by the left speaker 8 or right speaker 8'. The acoustic characteristics of the playback room 10 affect the sound, adding early reflections and reverberations. The influence of the room is different in each location; hence the sound arriving at the left ear is different from the sound arriving at the right one. The subject's head 12' affects the sound by reflecting it into one ear 28 and obstructing it from the other 28'. The sound passes through the pinnas 30, 30' before being recorded by left and right microphones 38, 38' which are placed inside the ear canals 32, 32'. The output signals of microphones 38, 38' are amplified by microphone preamplifiers 22, 22' and analyzed by signal analyzer 24. Signal analyzer 24 analyzes two separate signals: one from the left ear and one from the right.

A total of four different measurements are taken during this phase: two measurements (left and right ear) from left speaker 8 and two from right speaker 8'. In a case where the user has more than two speakers, two measurements are taken from each additional speaker.

FIG. 7 illustrates a speaker virtualizing system. Two filters 36, 36' are placed between audio source 26 and power amplifiers 6, 6'. The left and right speakers 8, 8', respectively, reproduce the audio.

As long as the listener 12 and speakers 8, 8' are located in the same spot used for the measurement (see FIG. 6), and the acoustic characteristics of the room are not significantly changed, the user will hear the sound as if it were originated by a virtual speaker 8", positioned at angle α. The sound of virtual speaker 8" will be similar to that of the real speaker 8 that was used for the dummy head measurement, which was placed in the room 10 (see FIG. 1).

The overall transfer function of the system of FIG. 7 would be:

$$HVS^{\beta,\gamma}_{(Left)} = \begin{bmatrix} F^{\alpha,\beta,\gamma}_{(Left)} \otimes H_{(\text{Power_amplifier})} \otimes H_{(\text{Left_Speaker})} \otimes \\ H^{\gamma}_{(\text{P_room_left})} \otimes H^{\gamma}_{(\text{Human_head_obstruction_left})} \otimes \\ H^{\gamma}_{(\text{Human_left_pinna})} \otimes H_{(\text{Human_left_ear_canal})} \otimes \\ H_{(\text{Left_eardrum})} \end{bmatrix} + \begin{bmatrix} F^{\alpha,\beta,\gamma}_{(Right)} \otimes H_{(\text{Power_amplifier})} \otimes H_{(\text{Right_Speaker})} \otimes \\ H^{\beta}_{(\text{P_room_left})} \otimes H^{\beta}_{(\text{Human_head_obstruction_left})} \otimes \\ H^{\beta}_{(\text{Human_left_pinna})} \otimes H_{(\text{Human_left_ear_canal})} \otimes \\ H_{(\text{Left_eardrum})} \end{bmatrix} \quad (15)$$

$$HVS^{\beta,\gamma}_{(Right)} = \begin{bmatrix} F^{\alpha,\beta,\gamma}_{(Left)} \otimes \\ H_{(\text{Power_amplifier})} \otimes \\ H_{(\text{Left_Speaker})} \otimes \\ H^{\gamma}_{(\text{P_room_right})} \otimes \\ H^{\gamma}_{(\text{Human_head_obstruction_right})} \otimes \\ H^{\gamma}_{(\text{Human_right_pinna})} \otimes \\ H_{(\text{Human_right_ear_canal})} \otimes \\ H_{(\text{Right_eardrum})} \end{bmatrix} + \begin{bmatrix} F^{\alpha,\beta,\gamma}_{(Right)} \otimes \\ H_{(\text{Power_amplifier})} \otimes \\ H_{(\text{Rightt_Speaker})} \otimes \\ H^{\beta}_{(\text{P_room_right})} \otimes \\ H^{\beta}_{(\text{Human_head_obstruction_right})} \otimes \\ H^{\beta}_{(\text{Human_right_pinna})} \otimes \\ H_{(\text{Human_right_ear_canal})} \otimes \\ H_{(\text{Right_eardrum})} \end{bmatrix} \quad (16)$$

wherein:

HVS is Human-Virtualized-Speakers constellation, and $H_{(P\text{—}room\ \ldots)}$ is the transfer function of the playback room.

FIG. 8 illustrates a two-speaker virtualizing system simulating three virtual speakers $\mathbf{8}^{II}$, $\mathbf{8}^{III}$, $\mathbf{8}^{IV}$. Two filters 46, 48 are placed between a first audio source 40 and adders 42, 44. Filters 50, 52 filter a second source 54 and filters 56, 58 filter a third source 60. The left adder 42 sums up the results of all the left filters (46, 50 and 56, and right adder 44 sums the results of all the right filters (48, 52 and 58). The output of adders 42, 44 is amplified by power amplifiers 62, 64 and reproduced by the left and right speakers 8, 8', respectively. The transfer function of each pair of filters determines the position of the respective virtual speaker.

The above-described method is suitable for the reproduction of any number of virtual speakers, and is not limited to specific azimuth, elevation and distance range. It is also possible to simulate different acoustic environments by changing the room used for the original measurement. Adding more real speakers to the system will enable control of additional aspects of the listening experience, as described in the mathematical section below.

The physical and mathematical development of the prior art systems and the system of the present invention are as follows:

In the prior art systems, development of Eq. 13, while using Eq. 9 for the left filter, provides:

$$HV^{\beta}_{(Left)} = F^{\alpha}_{(Left)} \otimes \begin{bmatrix} H_{(\text{Power_amplifier})} \otimes H_{(\text{Left_ear_piece})} \otimes H^{\beta}_{(\text{Human_left_pinna})} \otimes \\ H_{(\text{Human_left_ear_canal})} \otimes H_{(\text{Left_eardrum})} \end{bmatrix} \Longleftrightarrow$$

$$HV^{\beta}_{(Left)} = DS^{\alpha}_{(Left)} \otimes \begin{bmatrix} H_{(\text{Power_amplifier})} \otimes H_{(\text{Left_ear_piece})} \otimes H^{\beta}_{(\text{Human_left_pinna})} \otimes \\ H_{(\text{Human_left_ear_canal})} \otimes H_{(\text{Left_eardrum})} \end{bmatrix} \Longleftrightarrow$$

$$HV^{\beta}_{(Left)} = \begin{bmatrix} H_{(\text{Power_amplifier})} \otimes H_{(Speaker)} \otimes \\ H^{\alpha}_{(\text{Room_at_left_ear})} \otimes \\ H^{\alpha}_{(\text{Dummy_head_obstruction_at_left_ear})} \otimes \\ H^{\alpha}_{(\text{Dummy_head_left_pinna})} \otimes \\ H_{(\text{Dummy_head_left_ear_canal})} \otimes \\ H_{(\text{Left_microphone})} \otimes H_{(\text{Microphone_pre_amplifier})} \end{bmatrix} \otimes$$

$$\begin{bmatrix} H_{(\text{Power_amplifier})} \otimes H_{(\text{Left_ear_piece})} \otimes \\ H^{\beta}_{(\text{Human_left_pinna})} \otimes H_{(\text{Human_left_ear_canal})} \otimes \\ H_{(\text{Left_eardrum})} \end{bmatrix} \Longleftrightarrow$$

$$HV^{\beta}_{(Left)} = HS^{\alpha}_{(Left)} \otimes \begin{bmatrix} H_{(\text{Left_ear_piece})} \otimes H_{(\text{Power_amplifier})} \otimes \\ H^{\alpha}_{(\text{Dummy_head_left_pinna})} \otimes \\ H_{(\text{Dummy_head_left_ear_canal})} \otimes \\ H_{(\text{Left_microphone})} \otimes \\ H_{(\text{Microphone_pre_amplifier})} \end{bmatrix} \otimes$$

$$\left[ \frac{H^{\alpha}_{(\text{Dummy_head_obstruction_at_left_ear})}}{H^{\alpha}_{(\text{Human_head_obstruction_at_left_ear})}} \right]$$

Evidently, the sound of the virtualized system is very different from that of a speaker system. It is possible to pre-measure and eliminate the linear part from the transfer function of the power amplifier, the speaker, the microphone and the microphone pre-amplifier, however, the nonlinear parts of those devices will remain active.

It is impossible to isolate the transfer functions of the dummy head's pinna and ear canal from that of the system. Therefore, a person listening to such a system will hear the sound filtered through the dummy head's ears, as well as his own.

Hence, prior art virtualized systems sound different from real speakers.

In contradistinction to the prior art systems, the development of Eq. 13 while using Eq. 11 for the filter description according to the present invention, yields:

$$HV^{\beta}_{(Left)} = F^{\alpha}_{(Left)} \otimes \begin{bmatrix} H_{(\text{Power_amplifier})} \otimes H_{(\text{Left_ear_piece})} \otimes H^{\beta}_{(\text{Human_left_pinna})} \otimes \\ H_{(\text{Human_left_ear_canal})} \otimes H_{(\text{Left_eardrum})} \end{bmatrix} \Longleftrightarrow$$

$$HV^{\beta}_{(Left)} = \left[ \frac{DS^{\alpha}_{(Left)}}{DP^{\beta}_{(Left)}} \right] \otimes$$

-continued $$\begin{bmatrix} H_{(\text{Power_amplifier})} \otimes H_{(\text{Left_ear_piece})} \otimes H^{\beta}_{(\text{Human_left_pinna})} \otimes \\ H_{(\text{Human_left_ear_canal})} \otimes H_{(\text{Left_eardrum})} \end{bmatrix} \Longleftrightarrow$$

$$HV^{\beta}_{(Left)} = \frac{\begin{bmatrix} H_{(\text{Power_amplifier})} \otimes H_{(Speaker)} \otimes \\ H^{\alpha}_{(\text{Room_at_left_ear})} \otimes \\ H^{\alpha}_{(\text{Dummy_head_obstruction_at_left_ear})} \otimes \\ H^{\alpha}_{(\text{Dummy_head_left_pinna})} \otimes \\ H_{(\text{Dummy_head_left_ear_canal})} \otimes \\ H_{(\text{Left_microphone})} \otimes H_{(\text{Microphone_pre_amplifier})} \end{bmatrix}}{\begin{bmatrix} H_{(\text{Power_amplifier})} \otimes H_{(\text{Left_ear_piece})} \otimes \\ H^{\beta}_{(\text{Dummy_head_left_pinna})} \otimes \\ H_{(\text{Dummy_head_left_ear_canal})} \otimes \\ H_{(\text{Left_microphone})} \otimes H_{(\text{Microphone_pre_amplifier})} \end{bmatrix}} \otimes$$

$$\begin{bmatrix} H_{(\text{Power_amplifier})} \otimes H_{(\text{Left_ear_piece})} \otimes \\ H^{\beta}_{(\text{Human_left_pinna})} \otimes H_{(\text{Human_left_ear_canal})} \otimes \\ H_{(\text{Left_eardrum})} \end{bmatrix} \Longleftrightarrow$$

$$HV^{\beta}_{(Left)} = \begin{bmatrix} H_{(\text{Power_amplifier})} \otimes H^{\beta}_{(\text{Left_ear_pinna})} \otimes H_{(\text{Human_left_ear_canal})} \otimes \\ H_{(\text{Left_eardrum})} \otimes H_{(Speaker)} \otimes H^{\alpha}_{(\text{Room_at_left_ear})} \otimes \\ H^{\alpha}_{(\text{Dummy_head_obstruction_at_left_ear})} \end{bmatrix} \Longleftrightarrow$$

$$HV^{\beta}_{(Left)} = HS^{\alpha}_{(Left)} \otimes \left[ \frac{H^{\alpha}_{(\text{Dummy_head_obstruction_at_left_ear})}}{H^{\alpha}_{(\text{Human_head_obstruction_at_left_ear})}} \right]$$

In a similar way, it can be shown that development of Eq. 14 would result in:

$$HV^{\beta}_{(Right)} = HS^{\alpha}_{(Right)} \otimes \left[ \frac{H^{\alpha}_{(\text{Dummy_head_obstruction_at_right_ear})}}{H^{\alpha}_{(\text{Human_head_obstruction_at_right_ear})}} \right]$$

From these equations, it can be seen that the difference between the virtualized system and the real-speaker system is the difference between the obstruction characteristics of the dummy head and the listener's head. The most significant difference between the obstruction characteristics is caused by the differences in head size, which result in different delays between the arrival time to both ears. It is possible to provide a calibration feature to the system that would change the delay manually or automatically and cause the virtualized system to sound like a real one.

As long as the headphones used for playback are similar to those used for the experiment, the virtualized system will sound just like a real speaker system with a speaker positioned at angle $\alpha$.

It is desirable to use the best equipment the best recording room possible for the experiment. The sound of the virtualized system will sound like the very speaker used for the experiment, placed in the very room used for the experiment. Thus, it is possible to simulate excellent speakers and excellent playback rooms, while in fact the listener is using relatively simple and inexpensive equipment.

The two equations describing the transfer function of the two-speaker surround system (Eq. 15 and Eq. 16, FIG. 7) are:

$$HVS^{\beta,\gamma}_{(Left)} = \begin{bmatrix} F^{\alpha,\beta,\gamma}_{(Left)} \otimes H_{(\text{Power_amplifier})} \otimes H_{(\text{Left_Speaker})} \otimes \\ H^{\gamma}_{(\text{P_room_Left})} \otimes H^{\gamma}_{(\text{Human_head_obstruction_left})} \otimes \\ H^{\gamma}_{(\text{Human_left_pinna})} \otimes H_{(\text{Human_left_ear_canal})} \otimes \\ H_{(\text{left_eardrum})} \end{bmatrix} + \begin{bmatrix} F^{\alpha,\beta,\gamma}_{(Right)} \otimes H_{(\text{Power_amplifier})} \otimes H_{(\text{Right_Speaker})} \otimes \\ H^{\beta}_{(\text{P_room_left})} \otimes H^{\beta}_{(\text{Human_head_obstruction_left})} \otimes \\ H^{\beta}_{(\text{Human_left_pinna})} \otimes H_{(\text{Human_left_ear_canal})} \otimes \\ H_{(\text{Left_eardrum})} \end{bmatrix}$$

$$HVS^{\beta,\gamma}_{(Right)} = \begin{bmatrix} F^{\alpha,\beta,\gamma}_{(Left)} \otimes \\ H_{(\text{Power_amplifier})} \otimes \\ H_{(\text{Left_speaker})} \otimes \\ H^{\gamma}_{(\text{P_room_right})} \otimes \\ H^{\gamma}_{(\text{Human_head_obstruction_right})} \otimes \\ H^{\gamma}_{(\text{Human_right_pinna})} \otimes \\ H_{(\text{Human_right_ear_canal})} \otimes \\ H_{(\text{Right_eardrum})} \end{bmatrix} + \begin{bmatrix} F^{\alpha,\beta,\gamma}_{(Right)} \otimes \\ H_{(\text{Power_amplifier})} \otimes \\ H_{(\text{Right_speaker})} \otimes \\ H^{\beta}_{(\text{P_room_right})} \otimes \\ H^{\beta}_{(\text{Human_head_obstruction_right})} \otimes \\ H^{\beta}_{(\text{Human_right_pinna})} \otimes \\ H_{(\text{Human_right_ear_canal})} \otimes \\ H_{(\text{Right_eardrum})} \end{bmatrix}$$

In order to equalize these transfer functions with those of a real speaker placed in a real room (described in FIG. 3):

$$HVS_{(Left)}^{\beta,\gamma} = HS_{(Left)}^{\alpha}$$

and $$HVS_{(Right)}^{\beta,\gamma} = HS_{(Right)}^{\alpha}$$

It can now be written:

$$\begin{cases} HS^{\alpha}_{(Left)} = \begin{bmatrix} F^{\alpha,\beta,\gamma}_{(Left)} \otimes H_{(\text{Power_amplifier})} \otimes H_{(\text{Left_speaker})} \otimes \\ H^{\gamma}_{(\text{P_room_left})} \otimes H^{\gamma}_{(\text{head_obstruction_left})} \otimes \\ H^{\gamma}_{(\text{Human_left_pinna})} \otimes H_{(\text{Human_left_ear_canal})} \otimes \\ H_{(\text{Left_eardrum})} \end{bmatrix} + \\ \begin{bmatrix} F^{\alpha,\beta,\gamma}_{(Right)} \otimes H_{(\text{Power_amplifier})} \otimes H_{(\text{Right_speaker})} \otimes \\ H^{\beta}_{(\text{P_room_left})} \otimes H^{\beta}_{(\text{head_obstruction_left})} \otimes \\ H^{\beta}_{(\text{Human_left_pinna})} \otimes H_{(\text{Human_left_ear_canal})} \otimes \\ H_{(\text{Left_eardrum})} \end{bmatrix} \end{cases}$$

-continued $$\begin{cases} HS^{\alpha}_{(Right)} = \begin{bmatrix} F^{\alpha,\beta,\gamma}_{(Left)} \otimes \\ H_{(\text{Power_amplifier})} \otimes \\ H_{(\text{Left_speaker})} \otimes \\ H^{\gamma}_{(\text{P_room_right})} \otimes \\ H^{\gamma}_{(\text{head_obstruction_right})} \otimes \\ H^{\gamma}_{(\text{Human_right_pinna})} \otimes \\ H_{(\text{Human_right_ear_canal})} \otimes \\ H_{(\text{Right_eardrum})} \end{bmatrix} + \\ \begin{bmatrix} F^{\alpha,\beta,\gamma}_{(Right)} \otimes \\ H_{(\text{Power_amplifier})} \otimes \\ H_{(\text{Right_speaker})} \otimes \\ H^{\beta}_{(\text{P_room_right})} \otimes \\ H^{\beta}_{(\text{head_obstruction_right})} \otimes \\ H^{\beta}_{(\text{Human_right_pinna})} \otimes \\ H_{(\text{Human_right_ear_canal})} \otimes \\ H_{(\text{Right_eardrum})} \end{bmatrix} \end{cases}$$

The only unknowns in these equations are the transfer functions of the left and right filters. Since there are two unknowns and two equations, it is possible to find a single solution to those equations and calculate the filter's transfer function.

It is possible to use more than two real speakers in order to enhance the experience and add features to the system.

Adding a third real speaker, positioned in angle θ, and a third filter $F_3$ behind it, would change the equations to:

$$\begin{cases} HS^{\alpha}_{(Left)} = \begin{bmatrix} F^{\alpha,\beta,\gamma,\vartheta}_{(Left)} \otimes \\ H_{(\text{Power_amplifier})} \otimes \\ H_{(\text{Left_speaker})} \otimes \\ H^{\gamma}_{(\text{P_room_left})} \otimes \\ H^{\gamma}_{(\text{head_obstruction_left})} \otimes \\ H^{\gamma}_{(\text{Human_left_pinna})} \otimes \\ H_{(\text{Human_left_ear_canal})} \otimes \\ H_{(\text{Left_eardrum})} \end{bmatrix} + \\ \begin{bmatrix} F^{\alpha,\beta,\gamma,\vartheta}_{(Right)} \otimes \\ H_{(\text{Power_amplifier})} \otimes \\ H_{(\text{Right_speaker})} \otimes \\ H^{\beta}_{(\text{P_room_left})} \otimes \\ H^{\beta}_{(\text{head_obstruction_left})} \otimes \\ H^{\beta}_{(\text{Human_left_pinna})} \otimes \\ H_{(\text{Human_left_ear_canal})} \otimes \\ H_{(\text{Left_eardrum})} \end{bmatrix} + \\ \begin{bmatrix} F^{\alpha,\beta,\gamma,\vartheta}_{(3)} \otimes \\ H_{(\text{Power_amplifier})} \otimes \\ H_{(\text{Third_speaker})} \otimes \\ H^{\vartheta}_{(\text{P_room_left})} \otimes \\ H^{\vartheta}_{(\text{head_obstruction_left})} \otimes \\ H^{\vartheta}_{(\text{Human_left_pinna})} \otimes \\ H_{(\text{Human_left_ear_canal})} \otimes \\ H_{(\text{Left_eardrum})} \end{bmatrix} \end{cases}$$

-continued $$HS^{\alpha}_{(Right)} = \left( \begin{bmatrix} F^{\alpha,\beta,\gamma,\vartheta}_{(Left)} \otimes \\ H_{(\text{Power_amplifier})} \otimes \\ H_{(\text{Left_speaker})} \otimes \\ H^{\gamma}_{(\text{P_room_right})} \otimes \\ H^{\gamma}_{(\text{head_obstruction_right})} \otimes \\ H^{\gamma}_{(\text{Human_right_pinna})} \otimes \\ H_{(\text{Human_rightt_ear_canal})} \otimes \\ H_{(\text{right_eardrum})} \end{bmatrix} + \begin{bmatrix} F^{\alpha,\beta,\gamma,\vartheta}_{(Right)} \otimes \\ H_{(\text{Power_amplifier})} \otimes \\ H_{(\text{Right_speaker})} \otimes \\ H^{\beta}_{(\text{P_room_right})} \otimes \\ H^{\beta}_{(\text{head_obstruction_right})} \otimes \\ H^{\beta}_{(\text{Human_right_pinna})} \otimes \\ H_{(\text{Human_rightt_ear_canal})} \otimes \\ H_{(\text{Right_eardrum})} \end{bmatrix} + \begin{bmatrix} F^{\alpha,\beta,\gamma,\vartheta}_{(3)} \otimes \\ H_{(\text{Power_amplifier})} \otimes \\ H_{(\text{Third_speaker})} \otimes \\ H^{\vartheta}_{(\text{P_room_Right})} \otimes \\ H^{\vartheta}_{(\text{head_obstruction_right})} \otimes \\ H^{\vartheta}_{(\text{Human_right_pinna})} \otimes \\ H_{(\text{Human_left_ear_canal})} \otimes \\ H_{(\text{Left_eardrum})} \end{bmatrix} \right)$$

Now, there are two equations to solve and three unknowns: $F_{(Left)}$, $F_{(Right)}$ and $F_{(3)}$. In order to solve the equations, a restriction must be added. This restriction may be arbitrary and can be used to change the behavior of the system. It is possible, for instance, to control the size and shape of the "sweet spot" (the sitting position in which the surround experience is optimal).

Adding more speakers would require more restrictions and more filters. It can be shown that more speakers can add more "sweet spots" (actually, each pair of additional speakers can add one new "sweet spot"), create "dark spots" (areas in which the acoustic energy is reduced) or control the size and shape of the "sweet spot".

Different restrictions, controlling other features of the surround sensation, can be similarly developed.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

The invention claimed is:

1. A method for simulating a 3D sound environment using at least one sound transducer, said method comprising:

placing a dummy head having dummy left and right ears, pinnas and ear canals, in a selected acoustic environment;

recording first and second head-related transfer functions HRTF sound data transmitted via said at least one sound transducer and received by said dummy head by first and second microphones;

recording third and fourth HRTF sound data transmitted to said dummy head via a pair of headphones;

recording fifth and fourth HRTF sound data transmitted to said dummy head via a third transducer;

preparing transfer functions for left and right ear filters for each audio source channel by dividing, deconvolving or subtracting, respectively, first and second frequency representations of said sound data and said third, fourth, fifth and sixth sound data of each speaker, and introducing said left and right filters in a sound reproduction system between each audio source channel and two sound transducers connected to said system.

2. The method according to claim 1, wherein said HRTF is obtained by multiplying by a convolution operator at least two transfer functions selected from the group of functions related to a power amplifier, a speaker, room environment at left and right ears, dummy head obstruction at left and right ears, dummy head left and right ear canals, dummy head left and right pinnas, left and right microphones and microphone preamplifiers.

3. A method for simulating a 3D sound environment in an audio system using an at least two-channel reproduction device, said method comprising:

generating first and second pseudo head-related transfer function (HRTF) data, first using at least one sound transducer and then using at least two other transducers;

using a deconvolution operator on a time domain representation of said first and second data, and using the results of said deconvolution operator to prepare filters having an impulse response operable to initiate natural sounds of a remote transducer for preparing at least two filters connectable to said system in the audio path from an audio source to sound reproduction devices to be used by a listener, wherein said at least one sound transducer is located at a simulated 3D sound environment and said at least two other transducers are each located at a reproduction position.

4. A method of simulating a 3D sound environment in an audio system using an at least two-channel reproduction device, said method comprising:

generating first and second pseudo head-related transfer function (HRTF) data, first using at least one sound transducer and then using at least two other transducers;

subtracting a cepstrum representation of said first and second data, and using the results of said subtraction to prepare filters having an impulse response operable to initiate natural sounds of a remote transducer for preparing at least two filters connectable to said system in the audio path from an audio source to sound reproduction devices to be used by a listener, wherein said at least one sound transducer is located at a simulated 3D sound environment and said at least two other transducers are each located at a reproduction position.

5. The method as claimed claim 3, or claim 4, wherein said first and second transfer function data are calculated by using the equations $$HS^{\alpha}_{(Left)} = \begin{bmatrix} F^{\alpha,\beta,\gamma}_{(Left)} \otimes H_{(Power_amplfier)} \otimes H_{(Left_Speaker)} \otimes \\ H^{\gamma}_{(P_room_left)} \otimes H^{\gamma}_{(head_obstruction_left)} \otimes \\ H^{\gamma}_{(Human_left_pinna)} \otimes H_{(Human_left_ear_canal)} \otimes \\ H_{(Left_eardrum)} \end{bmatrix} + \begin{bmatrix} F^{\alpha,\beta,\gamma}_{(Right)} \otimes H_{(Power_amplfier)} \otimes H_{(Right_Speaker)} \otimes \\ H^{\beta}_{(P_room_left)} \otimes H^{\beta}_{(head_obstruction_left)} \otimes \\ H^{\beta}_{(Human_left_pinna)} \otimes H_{(Human_left_ear_canal)} \otimes \\ H_{(Left_eardrum)} \end{bmatrix}$$

$$HS^{\alpha}_{(Left)} = \begin{bmatrix} F^{\alpha,\beta,\gamma}_{(Left)} \otimes \\ H_{(Power_amplifier)} \otimes \\ H_{(Left_Speaker)} \otimes \\ H^{\gamma}_{(P_room_right)} \otimes \\ H^{\gamma}_{(head_obstruction_right)} \otimes \\ H^{\gamma}_{(Human_right_pinna)} \otimes \\ H_{(Human_right_ear_canal)} \otimes \\ H_{(Right_eardrum)} \end{bmatrix} + \begin{bmatrix} F^{\alpha,\beta,\gamma}_{(Left)} \otimes \\ H_{(Power_amplifier)} \otimes \\ H_{(Right_Speaker)} \otimes \\ H^{\beta}_{(P_room_right)} \otimes \\ H^{\beta}_{(head_obstruction_right)} \otimes \\ H^{\beta}_{(Human_right_pinna)} \otimes \\ H_{(Human_right_ear_canal)} \otimes \\ H_{(Right_eardrum)} \end{bmatrix}$$

wherein:

H is a transfer function;

α is a virtual speaker angle;

β is the angle between the head's median plane and the axis of a first speaker;

γ is the angle between the head's median plane and the axis of a second speaker;

$F^{\alpha\beta\gamma}$ is the transfer function that simulates a virtual speaker at angle α using two speakers located at β and γ angles;

☎is a convolution operator; and $HS^{\alpha}$ is the transfer function of the entire system.

6. An audio system for simulating a 3D sound environment having an audio source, audio reproducing and processing means and at least two speakers or headphones, said system comprising at least two filters, each filter being connected between said audio source and one of said speakers or headphones;

wherein each of said filters obtains an impulse response obtained by generating pseudo head-related transfer functions prepared by the method according to claim 3 or claim 4, and wherein said filters are calculated by the equations:

$$HS^{\alpha}_{(Left)} = \begin{bmatrix} F^{\alpha,\beta,\gamma}_{(Left)} \otimes H_{(Power_amplifier)} \otimes H_{(Left_speaker)} \otimes \\ H^{\gamma}_{(P_room_left)} \otimes H^{\gamma}_{(head_obstruction_left)} \otimes \\ H^{\gamma}_{(Human_left_pinna)} \otimes H_{(Human_left_ear_canal)} \otimes \\ H_{(Left_eardrum)} \end{bmatrix} + \begin{bmatrix} F^{\alpha,\beta,\gamma}_{(Right)} \otimes H_{(Power_amplifier)} \otimes H_{(Right_speaker)} \otimes \\ H^{\beta}_{(P_room_left)} \otimes H^{\beta}_{(head_obstruction_left)} \otimes \\ H^{\beta}_{(Human_left_pinna)} \otimes H_{(Human_left_ear_canal)} \otimes \\ H_{(Left_eardrum)} \end{bmatrix}$$

$$HS^{\alpha}_{(Right)} = \begin{bmatrix} F^{\alpha,\beta,\gamma}_{(Left)} \otimes \\ H_{(Power_amplifier)} \otimes \\ H_{(Left_speaker)} \otimes \\ H^{\gamma}_{(P_room_right)} \otimes \\ H^{\gamma}_{(head_obstruction_right)} \otimes \\ H^{\gamma}_{(Human_right_pinna)} \otimes \\ H_{(Human_right_ear_canal)} \otimes \\ H_{(Right_eardrum)} \end{bmatrix} + \begin{bmatrix} F^{\alpha,\beta,\gamma}_{(Right)} \otimes \\ H_{(Power_amplifier)} \otimes \\ H_{(Right_speaker)} \otimes \\ H^{\beta}_{(P_room_right)} \otimes \\ H^{\beta}_{(head_obstruction_right)} \otimes \\ H^{\beta}_{(Human_right_pinna)} \otimes \\ H_{(Human_right_ear_canal)} \otimes \\ H_{(Right_eardrum)} \end{bmatrix}$$

wherein:

H is a transfer function:

α is a virtual speaker angle;

β is the angle between the head's median plane and the axis of a first speaker;

γ is the angle between the head's median plane and the axis of a second speaker;

$F^{\alpha\beta\gamma}$ is the transfer function that simulates a virtual speaker at an angle α using two speakers located at β and γ angles;

⊗is a convolution operator; and $HS^{\alpha}$ is the transfer function of the entire system.

* * * * *